US008529974B2

(12) United States Patent
Ortiz et al.

(10) Patent No.: US 8,529,974 B2
(45) Date of Patent: Sep. 10, 2013

(54) COLLAPSIBLE CONTAINER

(75) Inventors: Diana Ortiz, Irving, TX (US); Jason Billig, Mount Vernon, NY (US); Stuart Leslie, Larchmont, NY (US)

(73) Assignee: PepsiCo., Inc., Purchase, NY (US)

( * ) Notice: Subject to any disclaimer, the term of this patent is extended or adjusted under 35 U.S.C. 154(b) by 246 days.

(21) Appl. No.: 12/985,635

(22) Filed: Jan. 6, 2011

(65) Prior Publication Data

US 2011/0174814 A1 Jul. 21, 2011

Related U.S. Application Data

(60) Provisional application No. 61/296,346, filed on Jan. 19, 2010.

(51) Int. Cl.
*B65D 81/34* (2006.01)

(52) U.S. Cl.
USPC ..... 426/111; 426/112; 426/115; 220/8; 206/804; 206/815

(58) Field of Classification Search
USPC ..... 426/106, 111, 112, 113, 115; 220/8, 220/23.83, 495.01; 206/804, 815
See application file for complete search history.

(56) References Cited

U.S. PATENT DOCUMENTS

| | | | | | |
|---|---|---|---|---|---|
| 237,121 | A | * | 2/1881 | Minor | 206/527 |
| 1,276,326 | A | * | 8/1918 | Casper | 206/311 |
| 1,334,346 | A | * | 3/1920 | Boehm | 426/122 |
| 1,483,196 | A | * | 2/1924 | Prince | 229/87.08 |
| 1,884,066 | A | * | 10/1932 | Meadowcroft | 219/90 |
| 1,953,884 | A | * | 4/1934 | Mcaleer | 206/784 |
| 2,005,245 | A | * | 6/1935 | Stover | 426/115 |
| 2,031,834 | A | * | 2/1936 | Klefeker | 229/151 |
| 2,053,711 | A | * | 9/1936 | Glomb | 249/120 |
| 2,110,615 | A | * | 3/1938 | Wilcox | 206/525 |
| 2,266,001 | A | * | 12/1941 | Christianson | 248/132 |
| 2,270,935 | A | * | 1/1942 | Doering | 426/115 |
| 2,669,380 | A | * | 2/1954 | Grenier | 206/521.1 |
| 2,689,183 | A | * | 9/1954 | Colt | 426/115 |
| 2,880,902 | A | * | 4/1959 | Owsen | 220/8 |
| 3,273,760 | A | * | 9/1966 | Frankenberg | 222/386 |
| 3,338,474 | A | * | 8/1967 | Olson | 222/92 |
| 3,355,080 | A | * | 11/1967 | Rausing et al. | 229/123.1 |
| 3,439,827 | A | * | 4/1969 | Marland | 215/12.1 |
| 3,471,058 | A | * | 10/1969 | Latham et al. | 222/92 |
| 3,483,908 | A | * | 12/1969 | Donovan | 221/260 |
| 4,076,207 | A | * | 2/1978 | Austin | 249/66.1 |
| 4,394,906 | A | * | 7/1983 | Hollenbeck | 206/525 |

(Continued)

OTHER PUBLICATIONS

Canadian Office Action in related Canadian Patent Application No. 2,728,777; dated Jul. 4, 2012.

*Primary Examiner* — Rena Dye
*Assistant Examiner* — Chaim Smith
(74) *Attorney, Agent, or Firm* — Banner & Witcoff, Ltd.

(57) ABSTRACT

A collapsible container includes an outer cup, an inner cup located inside the outer cup, and a seal covering the container. The inner cup includes a base and a plurality of concentric sections that are configured to collapse toward an opening in the container, when a force is exerted toward the opening on the base. The plurality of concentric sections may include three concentric sections: a base section, a middle section, and a top section, wherein the base section perimeter is smaller than the middle section perimeter, and the middle section perimeter is smaller than the top section perimeter.

13 Claims, 7 Drawing Sheets

(56) References Cited

U.S. PATENT DOCUMENTS

| | | | | |
|---|---|---|---|---|
| 4,492,313 | A * | 1/1985 | Touzani | 215/372 |
| 4,685,273 | A * | 8/1987 | Caner et al. | 53/440 |
| 4,875,620 | A | 10/1989 | Lane, Sr. | |
| D317,567 | S | 6/1991 | Lane, Sr. | |
| D317,568 | S | 6/1991 | Lane, Sr. | |
| D317,569 | S | 6/1991 | Lane, Sr. | |
| D336,041 | S | 6/1993 | Zama | |
| 5,224,623 | A | 7/1993 | LaFleur | |
| D342,447 | S | 12/1993 | Aylward | |
| 5,337,915 | A * | 8/1994 | Hall, Jr. | 220/495.11 |
| D353,997 | S | 1/1995 | Kashino et al. | |
| 5,384,138 | A * | 1/1995 | Robbins et al. | 426/111 |
| D364,564 | S | 11/1995 | Moore | |
| 5,511,684 | A * | 4/1996 | Weaver, Jr. | 220/630 |
| 5,638,995 | A * | 6/1997 | Mazda | 222/215 |
| 5,782,376 | A | 7/1998 | Brauner et al. | |
| D414,413 | S | 9/1999 | Brown | |
| 5,979,710 | A | 11/1999 | Willemsen et al. | |
| 6,086,931 | A | 7/2000 | Whiteford | |
| D430,023 | S | 8/2000 | Shurtleff et al. | |
| 6,119,884 | A * | 9/2000 | Lowry | 220/62.13 |
| D438,794 | S | 3/2001 | Miles et al. | |
| D452,152 | S | 12/2001 | Meeker et al. | |
| D452,433 | S | 12/2001 | Lazaris | |
| D452,434 | S | 12/2001 | Sweeney | |
| D452,821 | S | 1/2002 | Westphal | |
| D453,108 | S | 1/2002 | Gasco | |
| D473,463 | S | 4/2003 | Armstrong et al. | |
| D507,740 | S | 7/2005 | Ruiz et al. | |
| D509,109 | S | 9/2005 | Vovan | |
| D519,831 | S | 5/2006 | de Cleir et al. | |
| D539,134 | S | 3/2007 | Wallach | |
| D542,649 | S | 5/2007 | Sagel et al. | |
| D543,452 | S | 5/2007 | Gehring et al. | |
| D543,843 | S | 6/2007 | Gehring et al. | |
| D546,672 | S | 7/2007 | Chou | |
| D548,069 | S | 8/2007 | Sagel et al. | |
| D561,020 | S | 2/2008 | Kessell et al. | |
| D574,703 | S | 8/2008 | Cassol et al. | |
| D575,148 | S | 8/2008 | Sagel | |
| D579,767 | S | 11/2008 | Wallach | |
| D597,404 | S | 8/2009 | Bianchini | |
| 2003/0089631 | A1 | 5/2003 | Petricca | |
| 2005/0127073 | A1 * | 6/2005 | Kusuma et al. | 220/6 |
| 2007/0275131 | A1 * | 11/2007 | Bertini et al. | 426/115 |
| 2008/0197153 | A1 | 8/2008 | Bourguignon et al. | |
| 2008/0210697 | A1 | 9/2008 | Kessell et al. | |

* cited by examiner

COLLAPSIBLE CONTAINER

CROSS REFERENCE TO RELATED APPLICATIONS

This Application claims priority to U.S. Provisional Application Ser. No. 61/296,346, filed Jan. 19, 2010.

FIELD OF THE INVENTION

The present invention relates to a container that can be used for a fluid material, such as liquid, gas, paste, or gel, wherein the container is adapted to collapse to discharge the fluid material.

BACKGROUND OF THE INVENTION

Consumer packaging is designed to take into consideration functionality and appearance. For example, consumption of food contained within a one-serve sized container is often achieved by the use of a spoon. The spoon may transfer the food content directly to the mouth of the consumer. A spoon is a further element that needs to be provided to allow for the contents of such a container to be consumed. Yogurt and custards and other gelatinous food consumer products, such as those having a jelly-like consistency are not to any significant extent able to be poured or dispensed quickly from a container due to their high viscosity and/or gelatinous nature. It is therefore necessary to use a spoon to transfer some if not a substantial part of the contents from the container. There also seems to be a trend with consumer packaging products for food container to allow the food contents to be dispensed without the need for further implements or utensils. The capability of a package to self dispense a significant part of the contents is being addressed by consumer packaging designers and manufacturers.

For example, in today's fast-paced society, where consumers are constantly on-the-go, a need exists for easy-to-consume, shelf-stable comestibles that could be preferably consumed in one bite without a spoon or other eating utensil. An example of such a comestible is an easy-to-consume gel-based product in a collapsible container.

There is, therefore, a need in the art for a container that is inexpensive and easy to use, and that eliminates the problems associated with the prior art containers. The present invention is directed to remedying these and other deficiencies of the prior art containers.

SUMMARY OF THE INVENTION

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

According to one aspect, the present invention relates to a container configured to hold edible contents that includes an outer cup, an inner cup located inside the outer cup, and a seal. The outer cup may comprise a bottom portion located at the bottom of the outer cup, a sidewall section engaged with the bottom portion, and an outer cup top portion engaged with the sidewall section. The bottom portion may further include a hole. The outer cup top portion may further include an outer cup perimeter flange that flares outwardly from the outer cup top portion. The inner cup may comprise a base, a plurality of collapsible sections, and an inner cup top portion. The plurality of collapsible sections may further include a top section, a middle section, and a base section. The inner cup top portion may further include an inner cup perimeter flange that flares outwardly from the inner cup top portion. A container opening may be defined in the inner cup top portion. The base may be accessible from through the hole in the outer cup. The seal may cover the container opening and may be affixed to the inner cup perimeter flange. Additionally, the base may be configured to collapse toward the container opening when a force is exerted toward the container opening through the hole on the inner cup, such that the base section collapses inside the middle section, and the base section and middle section collapse inside the top section, thereby discharging the edible contents from the container.

Additionally, this aspect of the invention may include additional features without departing from the invention. For example, the inner cup perimeter flange may engage the outer cup perimeter flange. The plurality of collapsible sections may be concentric, wherein the base section perimeter is less than the middle section perimeter and the middle section perimeter is less than the top section perimeter. Additionally, the inner cup may be made of a thermoform plastic and/or the outer cup may be made of a thermoform plastic. The seal may be made of a foil material. The container opening may be either circular or oval. Additionally, the outer cup may be stackable with a second outer cup such that the outer cup perimeter flange does not engage a perimeter flange on the second outer cup. Additionally, the inner cup may be stackable with a second inner cup such that the inner cup perimeter flange does not engage a perimeter flange on the second inner cup. Also, the sidewall section may include one or more of the following: logos, advertising content, or nutritional information.

According to another aspect, the present invention relates to a container comprising a first cup, a second cup located inside the first cup, an opening located at the top of the second cup, and a seal covering the opening. The first cup may comprise a first cup perimeter flange that flares outwardly from the perimeter of the top of the first cup. Additionally the second cup may comprise a base, a plurality of concentric sections, and a second cup perimeter flange that flares outwardly from the perimeter of the top of the second cup. The opening may be defined by the second cup perimeter flange. The seal may be affixed to the second cup perimeter flange. Additionally, the second cup may be configured to collapse within the first cup when a force is exerted toward the opening on the base, such that the plurality of concentric sections collapse toward the opening.

According to another aspect, the present invention relates to a container configured to hold edible contents that includes an outer cup, an inner cup located inside the outer cup, and a seal. The outer cup comprises a bottom portion located at the bottom of the outer cup, a sidewall section engaged with the bottom portion, and an outer cup top portion engaged with the sidewall section. The bottom portion may further include a hole. The outer cup top portion may further include an outer cup perimeter flange that flares outwardly from the outer cup top portion. The inner cup may include a base, a plurality of concentric and collapsible sections, and an inner cup top portion that engages the outer cup top portion. The plurality of concentric and collapsible sections may further include a top section, a middle section, and a base section, wherein the base section perimeter is less than the middle section perimeter, and the middle section perimeter is less than the top section perimeter. Additionally, the inner cup top portion may include an inner cup perimeter flange that flares outwardly from the inner cup top portion, such that the inner cup perimeter flange engages the outer cup perimeter flange. The inner cup top portion defines a container opening. The base may be accessible from through the hole in the outer cup. The seal covers the container opening and is affixed to the inner cup perimeter flange. The base may be configured to collapse toward the container opening when a force is exerted toward the container opening through the hole on the inner cup, such that the base section collapses inside the middle section, and the base section and middle section collapse inside the top section, thereby discharging the edible contents from the container.

These and other features and advantages of the present invention will become apparent from the description of the preferred embodiments, with reference to the accompanying drawing figures.

BRIEF DESCRIPTION OF THE FIGURES

A more complete understanding of the present invention and certain advantages thereof may be acquired by referring to the following description in consideration with the accompanying drawings, in which like reference numbers indicate like features, and wherein.

The reader is advised that the attached drawings are not necessarily drawn to scale.

DETAILED DESCRIPTION OF THE PREFERRED EMBODIMENTS

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

Figure 1A:
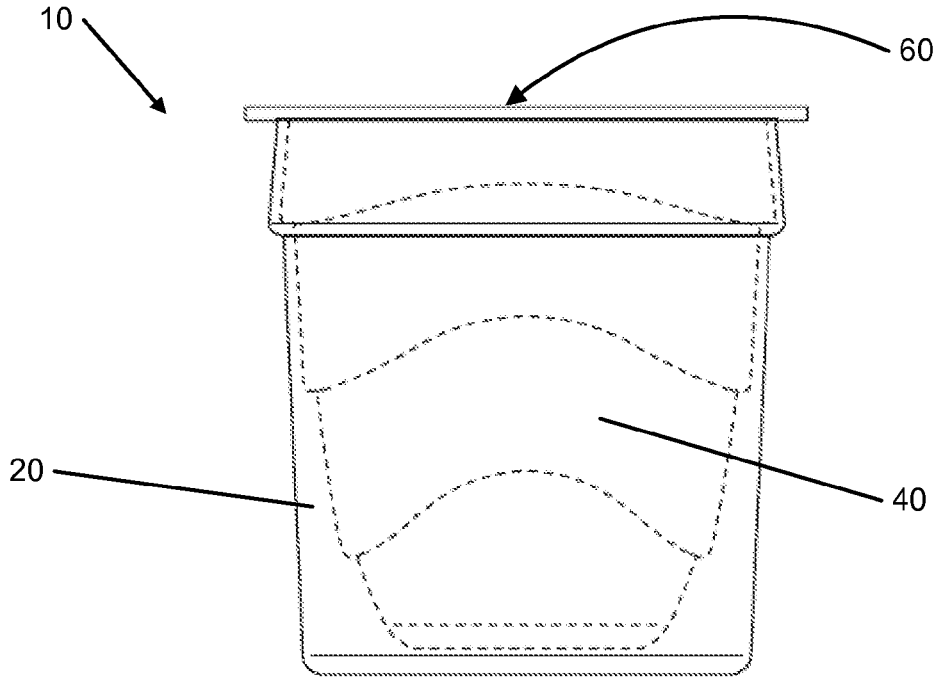
FIG. 1A is a front plan view of a collapsible container in accordance with at least some examples of this invention.
Figure 1B:
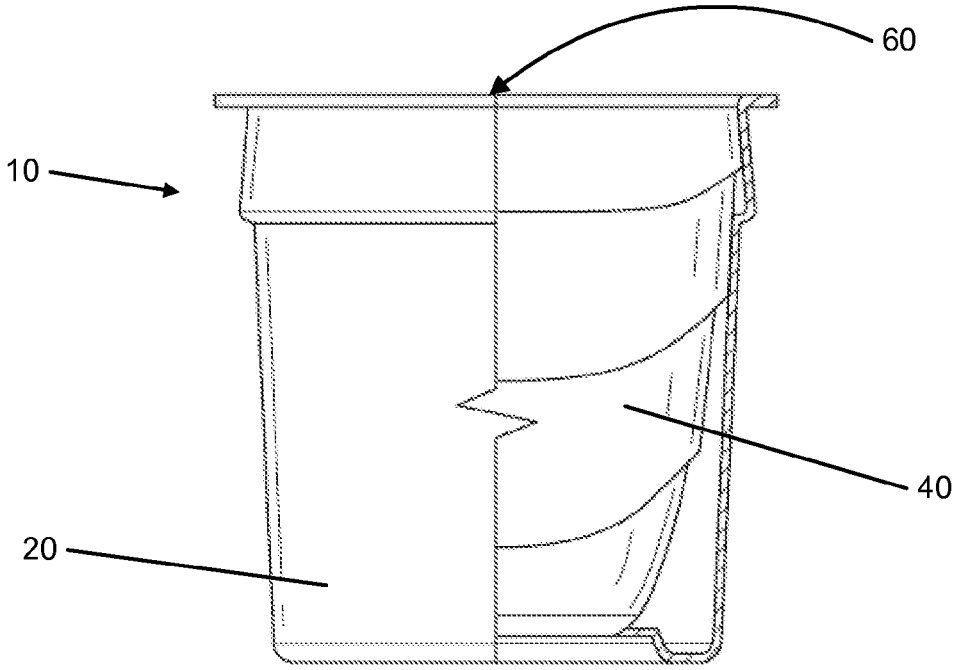
FIG. 1B is a side partial cut-away view of the collapsible container of FIG. 1A in accordance with at least some examples of this invention.
Figure 1C:
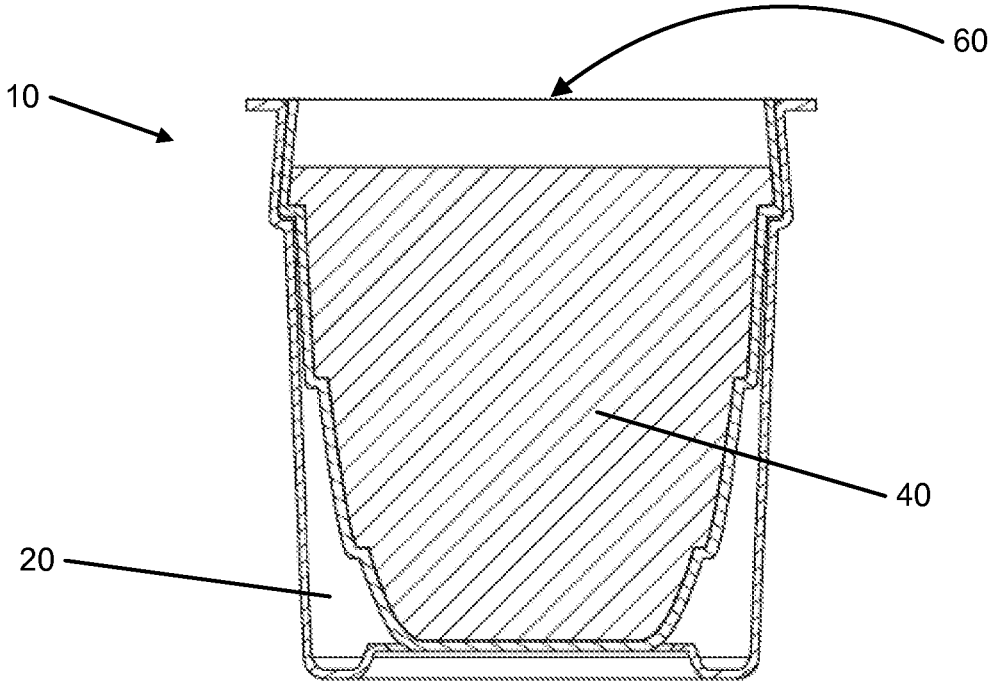
FIG. 1C is a side cut-away view of the collapsible container of FIG. 1A in accordance with at least some examples of this invention.
Figure 1D:
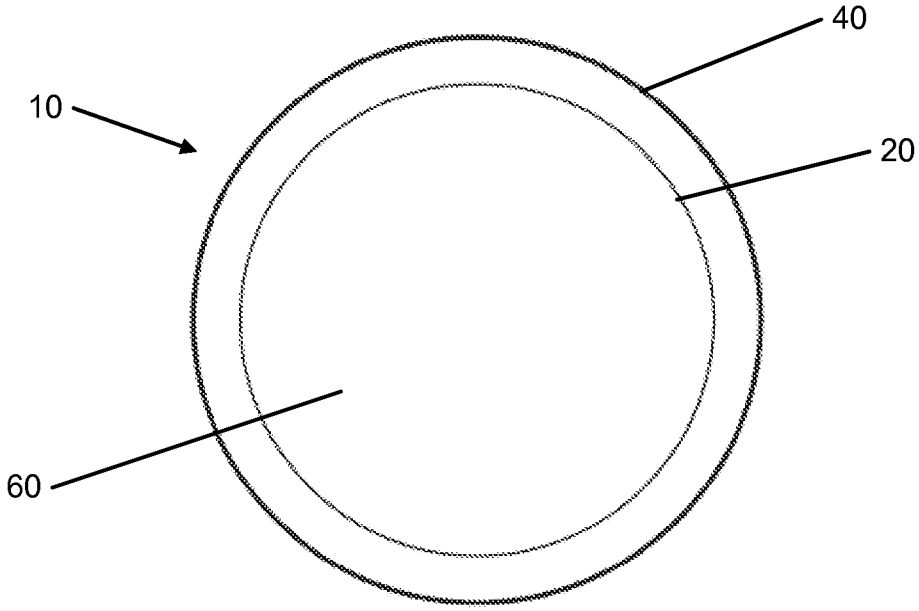
FIG. 1D is a top view of the collapsible container of FIG. 1A in accordance with at least some examples of this invention.

The present invention relates to a collapsible container 10. The collapsible container 10 is shown in FIGS. 1A through 1D. The collapsible container 10 may have a volume of between approximately 1 fluid ounce and 5 fluid ounces, and it will be appreciated that the container 10 can be upsized and downsized and still achieve the same functionality and desired characteristics as will be described herein. Although the foregoing embodiment relates to a container 10 that is circular, it will be apparent that the container 10 may also take other forms, for instance, oval, square, rectangular, or polygonal. As shown in FIGS. 1A and 1B, the collapsible container 10 may include a first cup 20, a second cup 40, and a seal 60.

Figure 2A:
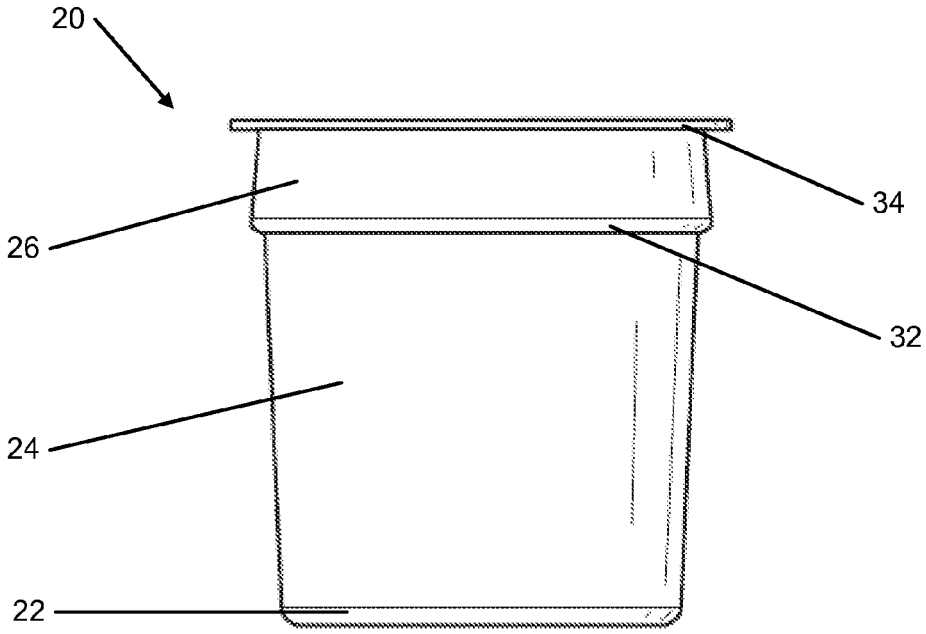
FIG. 2A is a front plan view of an outer cup from the collapsible container of FIG. 1A in accordance with at least some examples of this invention.
Figure 2B:
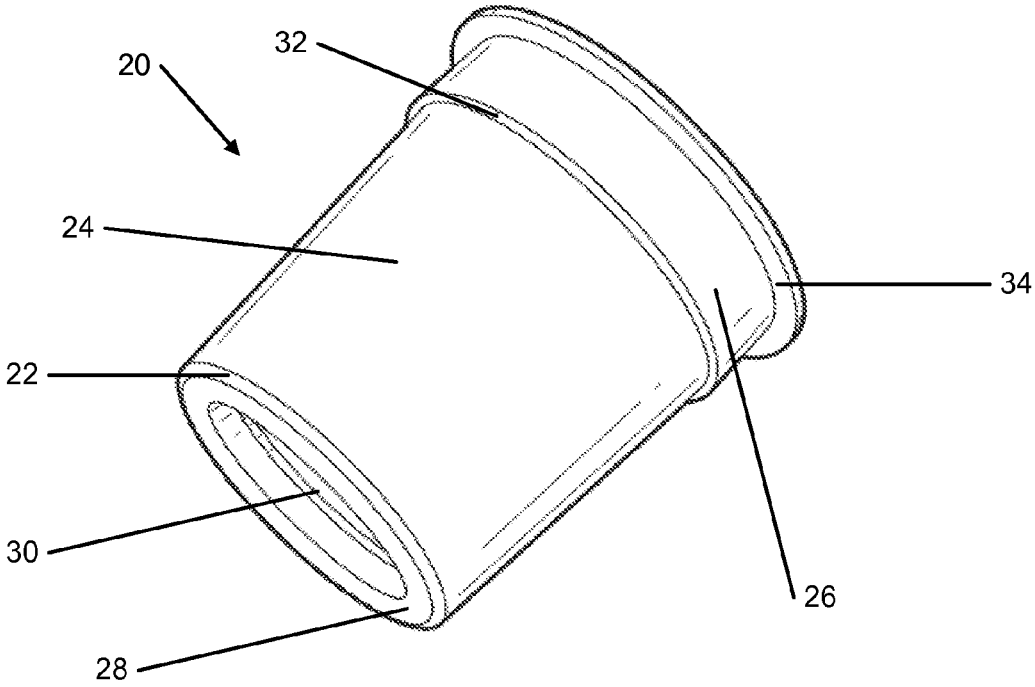
FIG. 2B is a perspective view of the outer cup of FIG. 2A in accordance with at least some examples of this invention.
Figure 2C:
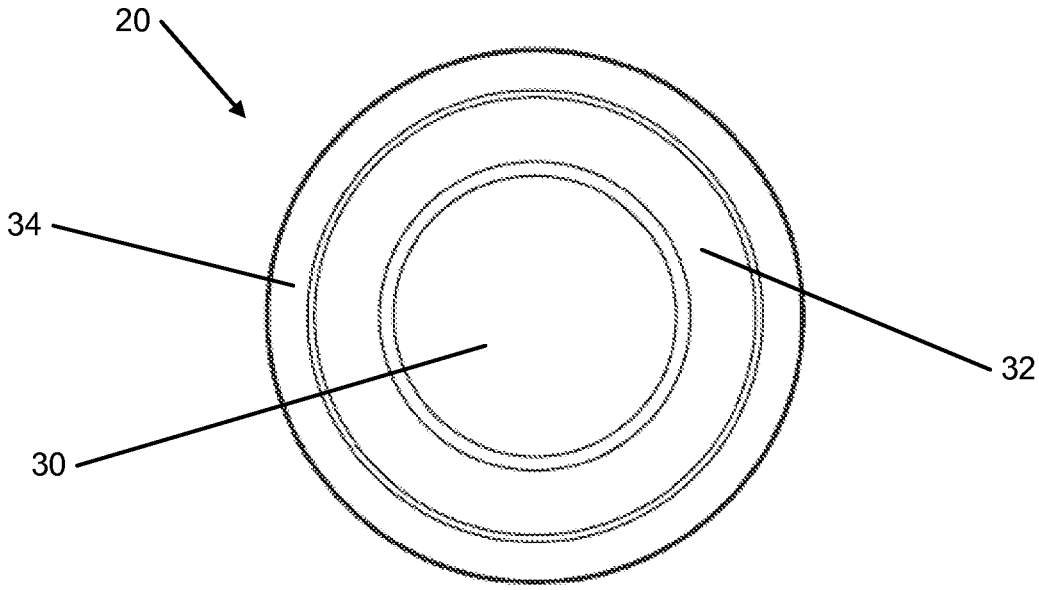
FIG. 2C is a top view of the outer cup of FIG. 2A in accordance with at least some examples of this invention.
Figure 6A:
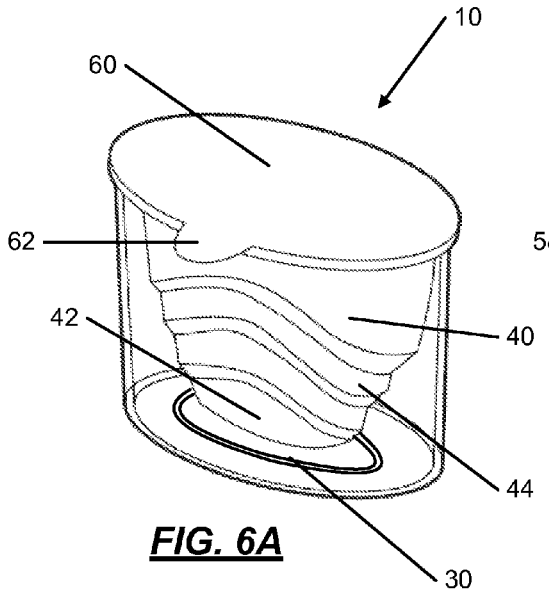
FIGS. 6A though 6C illustrate the use of the collapsible container of FIG. 1A in accordance with at least some examples of this invention.
Figure 6B:
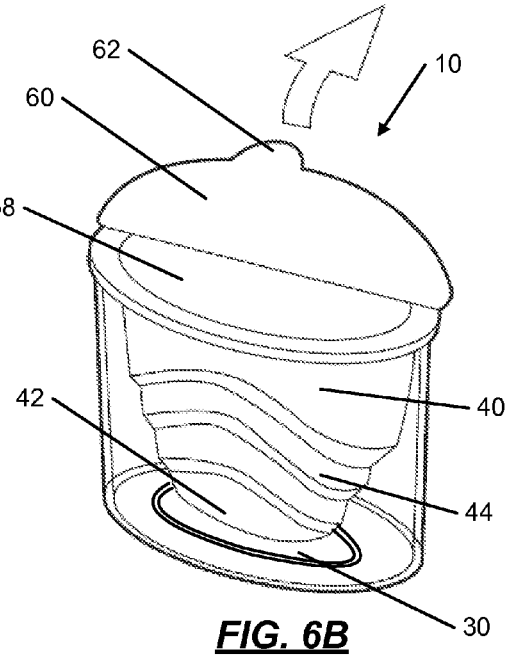
Figure 6C:
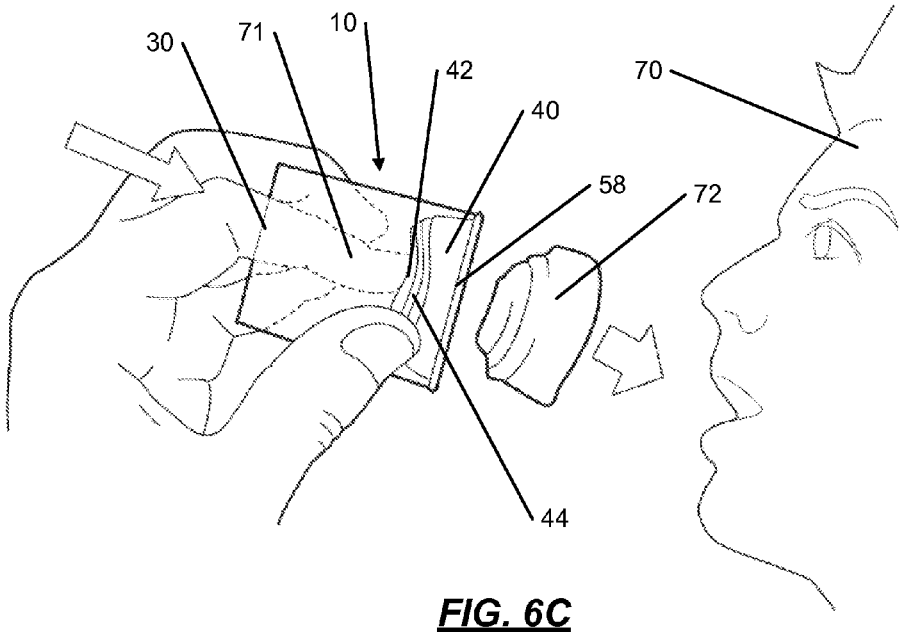

The first cup, or outer cup 20 is illustrated in more detail in FIGS. 2A through 2C. As is shown in FIGS. 2A and 2B, the outer cup 20 may be a circular structure. The outer cup 20 may be other shaped structures, such as an oval structure (as illustrated in FIGS. 6A through 6C), a rectangular structure, or other polygon shape structures without departing from the scope of this invention. The outer cup 20 may include a bottom portion 22, a side-wall section 24, and an outer cup top portion 26.

As shown in FIG. 2B, the bottom portion 22 may include a flat portion 28 located at the bottom of the container 10. The flat portion 28 may allow the container 10 to stand upright while seated on a flat surface. The bottom portion 22 may also include a hole 30. The hole 30 may consist of a portion of the entire area of the bottom portion 22 of the outer cup 20. The hole 30 may be circular in shape or may be other shapes without departing from the scope of this invention. Generally, the hole 30 may be big enough for a finger to move or push through.

Additionally as shown in FIGS. 2A and 2B, the side-wall section 24 is engaged with or located next to the bottom portion 22. The side-wall section 24 is generally a tubular shape and the same shape as the outer cup 20. For example, if the outer cup 20 is circular, the side-wall section 24 is also generally circular and if the outer cup 20 is oval, the side-wall section 24 is also generally oval. The side-wall section 24 has generally smooth sides. The side-wall section 24 may also have sides that are not smooth without departing from the scope of this invention. The side-wall section 24 may also include one or more logos, advertising content, or nutritional information for the given product inside the container 10.

Additionally, the side-wall section 24 may be substantially parallel, for example straight up and down. In another example in accordance with this invention, the side-wall section 24 may include a slight taper to help allow for the outer cups 20 to be stacked during manufacturing, shipping, or storage.

The outer cup top portion 26 is illustrated in FIGS. 2A and 2B. The outer cup top portion 26 may be engaged with or located next to the side-wall section 24. The outer cup top portion 26 includes a ridge 32. The ridge 32 may be located where the outer cup top portion 26 meets or engages the side-wall section 24. The ridge 32 may extend around the perimeter of the outer cup top portion 26. Additionally, the outer cup top portion 26 may include an outer cup perimeter flange 34. The outer cup perimeter flange 34 may be located at the top of the outer cup top portion 26, furthest away from the side-wall section 24. The outer cup perimeter flange 34 may flare outwardly from the outer cup top portion 24 and may extend around the perimeter of the outer cup top portion 26. The outer cup perimeter flange 34 includes both a top and a bottom.

The outer cup 20 may be made of many different types of materials. The outer cup 20 may preferably be made from plastic, and particularly those plastics which can result in a rigid surface when sufficiently thin, and ensure flexibility, for example thermoform plastics. Additionally, without departing from the scope of this invention, the outer cup 20 may be made of other materials, such as metals. Other materials known and used in the art may be used for the outer cup 20 without departing from the scope of this invention.

Figure 3C:
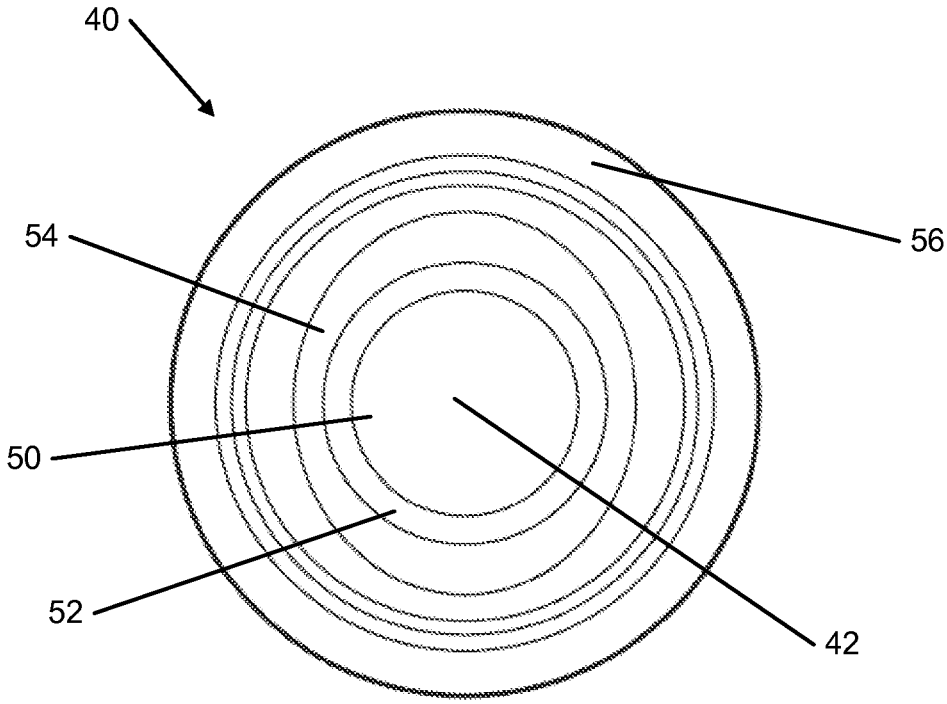
FIG. 3C is a top view of the inner cup of FIG. 3A in accordance with at least some examples of this invention.
Figure 3A:
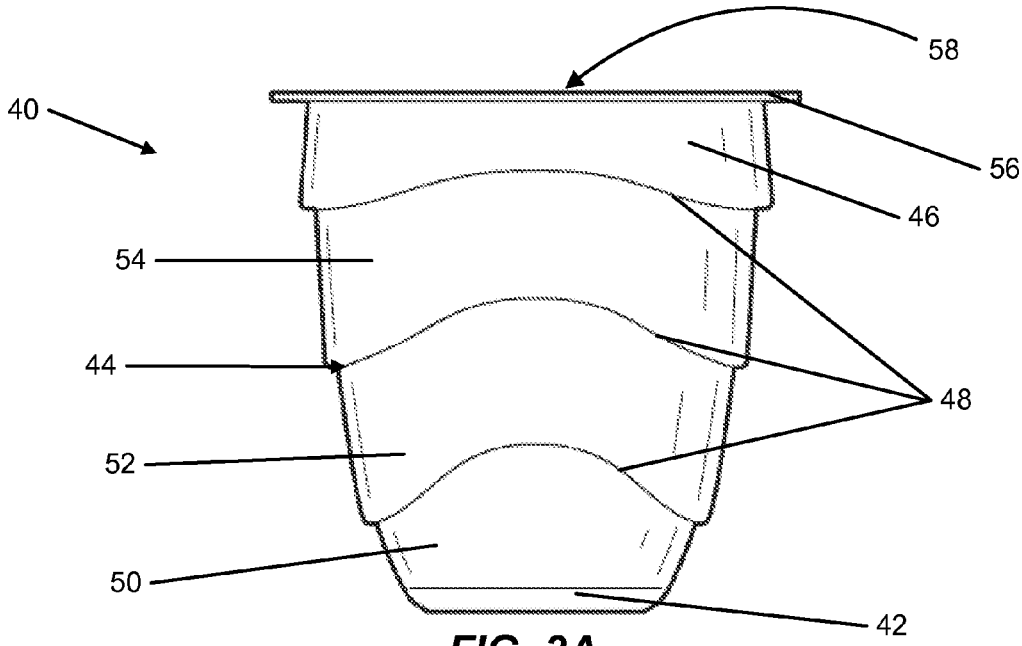
FIG. 3A is a front plan view of an inner cup from the collapsible container of FIG. 1A in accordance with at least some examples of this invention.
Figure 3B:
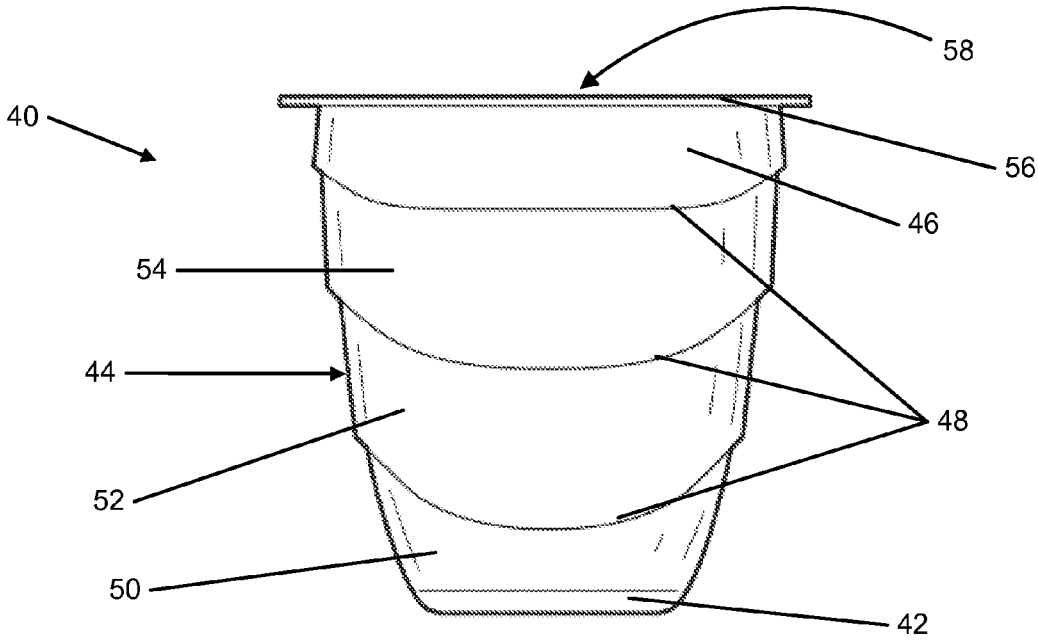
FIG. 3B is a side plan view of the inner cup of FIG. 3A in accordance with at least some examples of this invention.

Additionally, as shown in FIGS. 3A through 3C, the collapsible container 10 may include a second cup, or inner cup 40. The inner cup 40 may include a base 42, a plurality of collapsible sections 44, and an inner cup top portion 46. The base 42 may be located at the bottom of the inner cup 40. The base 42 may be rounded in shape. The base 42 may be other shapes, such as an oval (as illustrated in FIGS. 6A through 6C), rectangular, or other polygon shapes without departing from the scope of this invention.

The plurality of collapsible sections 44 may be located above the base and next to or engaged with the base 42 of the inner cup 40. Additionally, the plurality of collapsible sections 44 may be located in the middle area of the inner cup 40. Each collapsible section 44 may be separated by a section ridge 48. As shown in FIGS. 3A and 3B, the section ridges 48 may curve up and down around the inner cup 40, wherein the section ridges go up and down around the perimeter of the inner cup 48. The curving up and down of the section ridges 48 as described above and shown in FIGS. 3A and 3B helps to create the collapsible feature of the plurality of concentric sections 44. However, in other examples in accordance with this invention, the section ridges 48 may be straight, rather than curving around the inner cup.

As shown in FIGS. 3A and 3B, in one example according to the invention, the plurality of collapsible sections 44 may include three concentric and collapsible sections. The plurality of concentric sections 44 may include a base section 50, a middle section 52, and a top section 54. The base section 50 is located closest to the base 42 of the inner cup 40. Additionally, the base section 50 may be engaged with or next to the base 42 of the inner cup 40. The top section 54 is located closest to the inner cup top portion 46. Additionally, the top section 54 may be engaged with or next to the inner cup top portion 46. The middle section 52 may be located between the base section 50 and the top section 54. Each of the concentric sections 50, 52, 54 may be defined by the section ridge 48 located between each of the corresponding concentric sections 50, 52, 54. Additionally, the concentric sections 50, 52, 54 may have a differing circumference or perimeter. For example, as shown in FIGS. 3A and 3B, the base section 50 may have smaller circumference than the middle section 52. The middle section 52 may have a smaller circumference than the top section 54. If the concentric sections 50, 52, 54 are non-circular, then the concentric sections 50, 52, 54 may have a different perimeter, similar to as described above for the different circumference. Additionally, without departing from the scope of this invention, the plurality of concentric sections 44 may include a number of concentric sections other than three, such as two, four, or five or more.

As shown in FIGS. 3A and 3B, the inner cup top portion 46 is engaged with or located next to the top section 54 of the plurality of concentric sections 44. The inner cup top portion 46 may include an inner cup perimeter flange 56. The inner cup perimeter flange 56 may be located at the top of the inner cup top portion 46. The inner cup perimeter flange 56 may extend around the perimeter of the inner cup top portion 46. The inner cup perimeter flange 56 flares outwardly from the inner cup top portion 46 to present a surface with which the seal 60 can engage. The inner cup perimeter flange 56 may present a substantially continuous and planar engagement surface onto which the seal 60 can engage. The inner cup perimeter flange 56 includes both a top and a bottom. Additionally, the inner cup 46 includes a container opening 58 located at the top of the inner cup 40. The container opening 58 may also be defined by the inner cup perimeter flange 56.

The inner cup 40 may be made of many different types of materials. The inner cup 40 may preferably be made from plastic, and particularly those plastics which can result in a rigid surface when sufficiently thin, and ensure flexibility, for example thermoform plastics. Additionally, without departing from the scope of this invention, the inner cup 40 may be made of other materials, such as a thin collapsible metal. Other materials known and used in the art may be used for the inner cup 40 without departing from the scope of this invention.

Additionally, the collapsible container 10 may include a seal 60. As shown in FIGS. 6A and 6B the seal 60 may cover the opening 58. The seal 60 may include a pull-tab 62. The pull-tab 62 may be a tab located on an outside portion of the seal 60. A user may pull the pull-tab 62 by grasping and holding the pull-tab to remove the seal from the opening 58 and collapsible container 10. The seal 60 may be, for example, be made of a foil material. Other materials known and used in the art may be used for the seal 60 without departing from the scope of this invention.

Additionally, as shown in FIGS. 6A and 6B, the seal 60 may be slightly larger than the opening 58 to ensure that the opening 58 is completely covered. In other examples in accordance with examples of this invention, the seal 60 may be more than slightly larger than the opening 58. If the seal 60 is more than slightly larger than the opening 58, the excess material of the seal 60 may hang-over the opening 58.

As illustrated in FIGS. 1A and 1B, the elements of the container 10 according to this invention may be configured together such that the inner cup 40 is placed inside the outer cup 20 and the seal 60 is located over the opening 58. When the inner cup 40 is inserted into the outer cup 20, the outside of the inner cup top portion 46 engages and contacts with the inside of the outer cup top portion 26. As the inner cup 40 is inserted farther into the outer cup 20, the bottom of the inner cup perimeter flange 56 engages the top of the outer cup perimeter flange 34. Additionally, in examples in accordance with this invention, portions of the top section 54 ridge 48 of the inner cup 40 may also engage against portions of the ridge 32 of the outer cup 20. After the inner cup 40 is fully inserted into the upper cup 20, the inner cup 40 and the outer cup 20 may include one or more means of joining the two pieces together, such as an engagement fit, welding, gluing, thermal adhesive process or other means for joining plastics or like materials known in the art. The means for joining the two pieces together may include the area between the inner cup top portion 46 and the outer cup top portion 26, which may be by a friction fit or friction engagement. Additionally, another area may include the inner cup perimeter flange 56 and the outer cup perimeter flange 34, wherein the two perimeter flanges 34, 56 may be glued or thermally adhered in accordance with examples of this invention. Furthermore, when the inner cup 40 is fully inserted into the outer cup 20, the base 42 of the inner cup 40 may be substantially flush with the flat portion 28 of the outer cup 40.

Lastly, the seal 60 may be placed and located over the opening 58 and the container 10. The seal 60 may be affixed to the inner cup perimeter flange 56 by commonly known techniques that may allow for the seal 60 to be removed and peeled from the inner cup perimeter flange 56. One such technique may be a thermal adhesion process.

Figure 4:
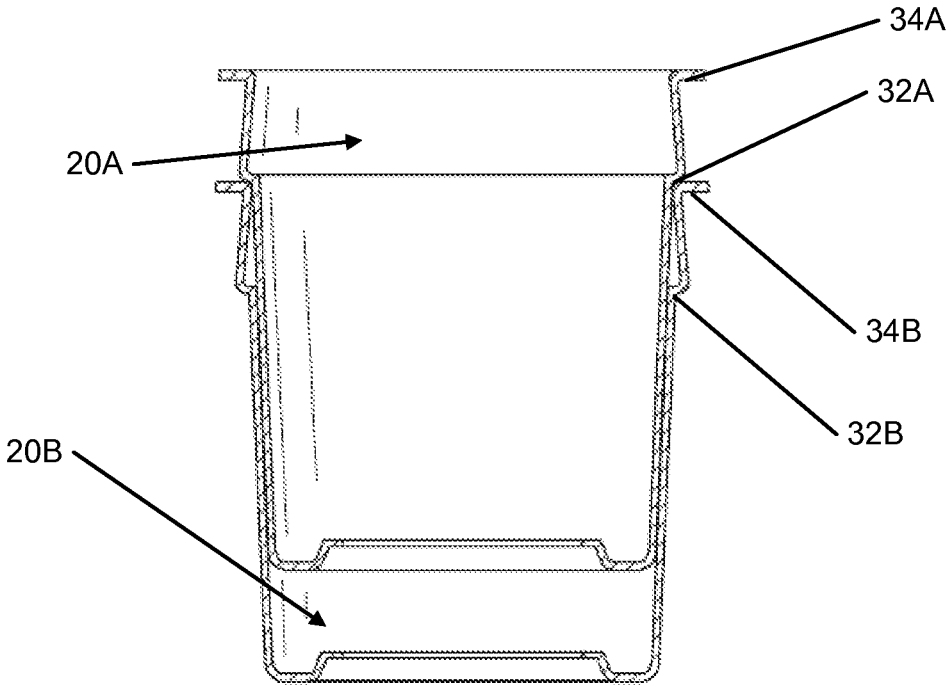
FIG. 4 is a cut-away front view of a stackable feature for the outer cup of FIG. 2A in accordance with at least some examples of this invention.

Additionally, as illustrated in FIG. 4, the outer cup 20 may be configured and manufactured to be stackable for manufacturing, shipping, packaging, storage, etc. When stacking a top outer cup 20A and a bottom outer cup 20B, the ridge 32A of the top outer cup 20A may engage with the outer cup perimeter ridge 34B as the top outer cup 20A is stacked inside the bottom outer cup 20B. This stackability may provide an advantage for manufacturing, shipping, and/or packaging. As can be seen in FIG. 4, the outer cup perimeter flange 34A of the top outer cup 20A may not contact the outer cup perimeter flange 34B of the bottom outer cup 20B in the stacked condition which may be desirable where the containers are provided in a stacked form. This stacked form may help to allow for a filling and sealing machine to grip a top most outer cup 20A or bottom most outer cup 20B of the stack for removal from the stack for subsequent filling and sealing.

Figure 5:
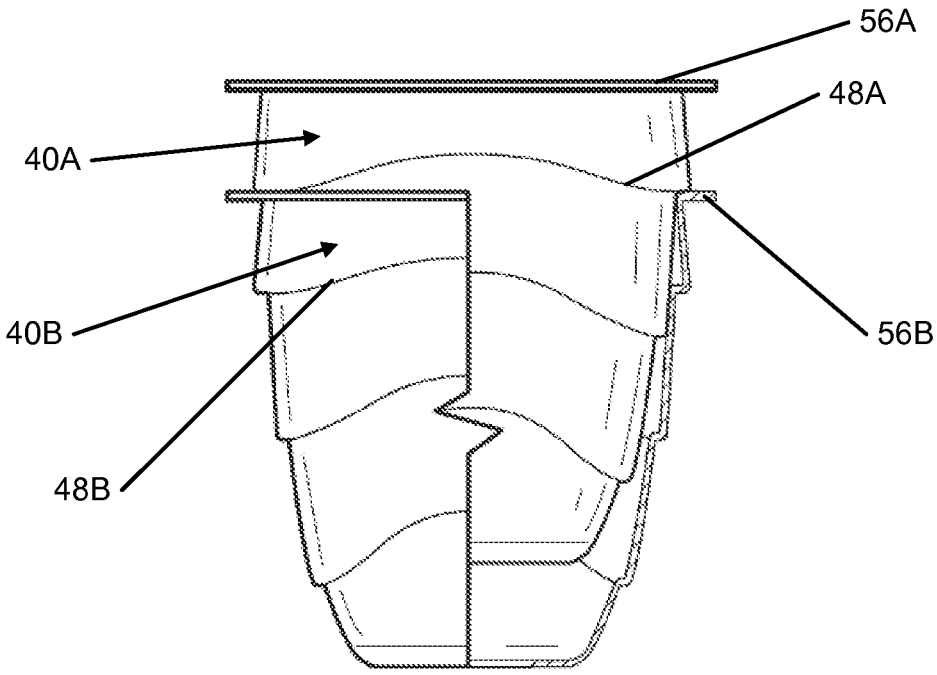
FIG. 5 is a partial cut-away front view of a stackable feature for the inner cup of FIG. 3A in accordance with at least some examples of this invention.

Additionally, as illustrated in FIG. 5, similar to the outer cup 20 as described above, the inner cup 40 may be configured and manufactured to be stackable for manufacturing, shipping, packaging, storage, etc. When stacking a top inner cup 40A and a bottom inner cup 40B, the top section ridge 48A of the top inner cup 40A may engage with the inner cup perimeter ridge 56B of the bottom cup 40B as the top inner cup 40A is stacked inside the bottom inner cup 40B. This stackability may provide an advantage for manufacturing, shipping, and/or packaging. As can be seen in FIG. 5, the inner cup perimeter flange 56A of the top inner cup 40A may not contact the inner cup perimeter flange 56B of the bottom inner cup 40B in the stacked condition which may be desirable where the containers are provided in a stacked form. This stacked form may help to allow for a filling and sealing machine to grip a top most inner cup 40A or bottom most inner cup 40B of the stack for removal from the stack for subsequent filling and sealing.

As illustrated in FIGS. 6A through 6C, the container 10 may be used to contain or hold an edible content 72. The edible content 72 may be an easy-to-consume, preferably shelf-stable, gel-based product that could be preferably consumed in one bite without a spoon. More particularly, the edible product 72 could relate to a soft gel-based product containing a gum and additional ingredients including, but not limited to food-grade acid, sodium citrate, calcium lactate, nutritive and non-nutritive sweetener, color, flavor, functional ingredients or combinations of these ingredients. Additionally, the edible product 72 could contain at least caffeine, taurine, a vitamin B complex and a gum. In other examples in accordance with this invention, the edible product 72 may also be a yogurt or custard or other gelatinous food consumer products, such as those having a jelly-like consistency that are not able to be poured or dispensed quickly from a container due to their high viscosity and/or gelatinous nature. Additionally, the container 10 may contain or hold other consumer products other than edible products without departing from the scope of this invention.

As illustrated in FIGS. 6A and 6B, for a user 70 to use the container 10, the user 70 may first remove the seal 60. The user 70 may remove the seal 60 by grasping or holding onto the pull-tab 62, thereby pulling the seal 60 from the opening 58 of the container 10. After removing the seal 60, as illustrated in FIG. 6C, the user 70 may then insert their finger or thumb 71 into the hole 30 at the bottom of the container 10. After the user 70 inserts their finger 71 into the hole 30, the user's finger 71 presses against the base 42 of inner cup 40, thereby exerting force against the inner cup 40 toward the opening 58 of the container 10. As the user continues to press their finger 71 against the base 42 of the inner cup 40, the inner cup 40 begins collapsing. For example, the plurality of concentric sections 44 may collapse within or against each other (such as a base section collapsing inside a middle section and the base section and the middle section collapsing inside a top section). As the plurality of concentric sections 44 collapse within or against each other, the edible content 72 is pressed out of the opening 58 of the container 10, thereby falling out of the container 10 and into the user's mouth 70. The user 70 may then consume or eat the edible content 72 and discard the container 10 after use.

CONCLUSION

The present invention is disclosed above and in the accompanying drawings with reference to a variety of examples. The purpose served by the disclosure, however, is to provide an example of the various features and concepts related to the invention, not to limit the scope of the invention. One skilled in the relevant art will recognize that numerous variations and modifications may be made to the aspects described above without departing from the scope of the present invention, as defined by the appended claims.

We claim:

1. A container configured to hold edible contents, the container comprising:

an outer cup comprising a bottom portion located at the bottom of the outer cup, a sidewall section engaged with the bottom portion, and an outer cup top portion engaged with the sidewall section, wherein the outer cup top portion includes an outwardly angled first ridge located where the outer cup top portion engages the sidewall section, the bottom portion further including a hole, and the outer cup top portion further including an outer cup perimeter flange that flares outwardly from the outer cup top portion;

an inner cup located inside the outer cup, the inner cup comprising a base, a plurality of collapsible sections, and an inner cup top portion, wherein the inner cup top portion includes an outwardly angled second ridge located where the inner cup top portion engages the plurality of collapsible sections, the plurality of collapsible sections further including a top section, a middle section, and a base section, and the inner cup top portion further including an inner cup perimeter flange that flares outwardly from the inner cup top portion, wherein a container opening is defined in the inner cup top portion, and the base is accessible through the hole in the outer cup, wherein the second ridge of the inner cup top portion engages the first ridge of the outer cup top portion thereby creating a friction-fit engagement between the inner cup and the outer cup; and a seal covering the container opening and affixed to the inner cup perimeter flange, wherein the base is configured to collapse toward the container opening when a force is exerted toward the container opening through the hole on the base, such that the base section collapses inside the middle section, and the base section and middle section collapse inside the top section, thereby discharging the edible contents from the container.

2. The container according to claim 1, wherein the inner cup perimeter flange engages the outer cup perimeter flange.

3. The container according to claim 1, wherein the plurality of collapsible sections are concentric.

4. The container according to claim 3, wherein the base section perimeter is less than the middle section perimeter and the middle section perimeter is less than the top section perimeter.

5. The container according to claim 1, wherein the inner cup is made of a thermoform plastic.

6. The container according to claim 1, wherein the outer cup is made of a thermoform plastic.

7. The container according to claim 1, wherein the seal is made of a foil material.

8. The container according to claim 1, wherein the container opening is circular.

9. The container according to claim 1, wherein the container opening is oval.

10. The container according to claim 1, wherein the outer cup is stackable with a second outer cup such that the outer cup perimeter flange does not engage a perimeter flange on the second outer cup.

11. The container according to claim 1, wherein the inner cup is stackable with a second inner cup such that the inner cup perimeter flange does not engage a perimeter flange on the second inner cup.

12. The container according to claim 1, wherein the sidewall section includes one or more of the following: logos, advertising content, or nutritional information.

13. A container configured to hold edible contents, the container comprising:

an outer cup comprising a bottom portion located at the bottom of the outer cup, a sidewall section engaged with the bottom portion, and an outer cup top portion engaged with the sidewall section, wherein the outer cup top portion includes an outwardly angled first ridge located where the outer cup top portion engages the sidewall section the bottom portion further including a hole, and the outer cup top portion further including an outer cup perimeter flange that flares outwardly from the outer cup top portion;

an inner cup located inside the outer cup, the inner cup comprising a base, a plurality of concentric and collapsible sections, and an inner cup top portion, wherein the inner cup top portion includes an outwardly angled second ridge located where the inner cup top portion engages the plurality of collapsible sections wherein the second ridge of the inner cup top portion engages the first ridge of the outer cup top portion thereby creating a friction-fit engagement between the inner cup and the outer cup, the plurality of concentric and collapsible sections further including a top section, middle section, and a base section, wherein the base section perimeter is less than the middle section perimeter, and the middle section perimeter is less than the top section perimeter, the inner cup top portion further including an inner cup perimeter flange that flares outwardly from the inner cup top portion, such that the inner cup perimeter flange engages the outer cup perimeter flange, and wherein a container opening is defined in the inner cup top portion, and the base is accessible through the hole in the outer cup; and a seal covering the container opening and affixed to the inner cup perimeter flange, wherein the base is configured to collapse toward the container opening when a force is exerted toward the container opening through the hole on the base, such that the base section collapses inside the middle section, and the base section and middle section collapse inside the top section, thereby discharging the edible contents from the container.

* * * * *